US005391099A

United States Patent [19]

Allain

[11] Patent Number: 5,391,099

[45] Date of Patent: Feb. 21, 1995

[54] AIR INTAKE PROTECTOR FOR OUTBOARD MOTOR

[76] Inventor: Charles V. Allain, 909 2nd St., Franklin, La. 70538

[21] Appl. No.: 178,894

[22] Filed: Jan. 7, 1994

[51] Int. Cl.[6] ..... B63H 21/26
[52] U.S. Cl. ..... 440/77
[58] Field of Search ..... 440/77, 88, 89; 123/195 P

[56] References Cited

U.S. PATENT DOCUMENTS 3,195,530 7/1965 Heidner ..... 440/77
3,610,198 10/1971 Alexandrowics ..... 440/77

*Primary Examiner*—Jesus D. Sotelo
*Attorney, Agent, or Firm*—Kennedy & Kennedy

[57] ABSTRACT

A cowling for enclosing a marine propulsion unit with a recess having a port that communicates air to the engine. A plate having spaced-apart openings is received on the port. A diverter screen covers the openings. The diverter screen is adapted for communicating air from the openings through the diverter screen to the port and for restricting flow of water therethrough.

10 Claims, 1 Drawing Sheet

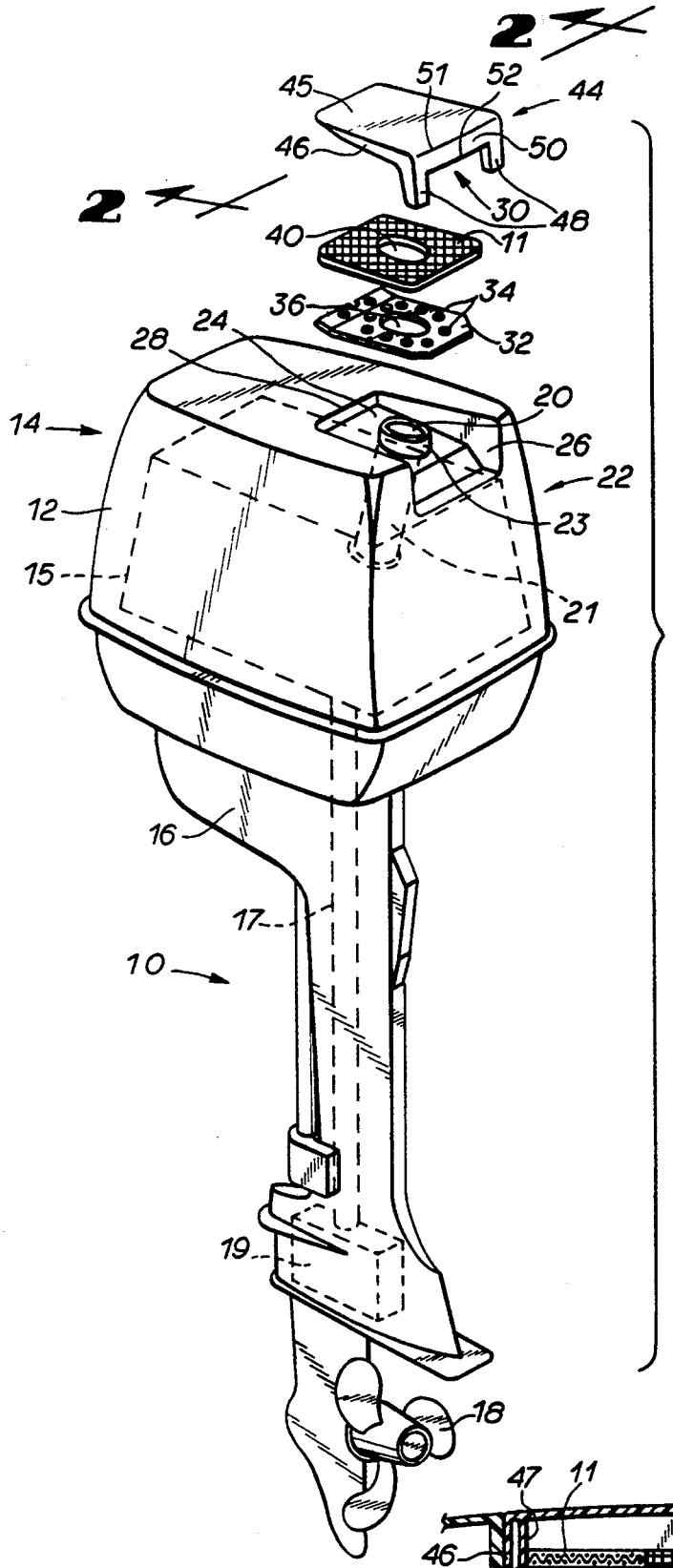
FIG 1
FIG 2
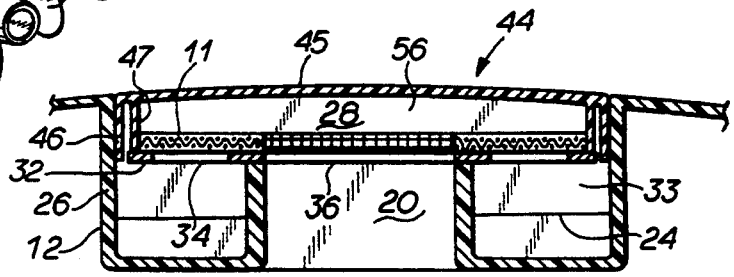

AIR INTAKE PROTECTOR FOR OUTBOARD MOTOR

TECHNICAL FIELD

This invention relates to an air intakes for marine outboard motors.

BACKGROUND OF THE INVENTION

Boating is a favored sports activity for many individuals, particularly during warmer periods of the year. Boating as an activity inofitself as well as for fishing occurs on lakes, rivers and oceans. Pleasure and fishing boats come in a number of different types and sizes. These boats are manually powered, such as canoes, kayaks, and rowboats, powered such as sailboats, catamarans, and the like, and power boats, such as ski boats, fishing boats, and cruisers.

Power boats use internal combustion motors as the power source for operating the boat. The motors are mounted in the boats as either an inboard motor or pivotally attached to a transom of the boat as an outboard motor. Both inboard and outboard power boats have air intakes for supplying air to the internal combustion motor. The air intake typically is an opening in a wall of a housing that encloses the engine. The opening connects to a passageway for communicating air to the engine. For example, an outboard motor is enclosed in a housing called a cowling. The cowling includes a port through which air for the engine passes. During operation of the engine, the port must be open for communicating air from the atmosphere to the engine. However, during operation of a pleasure boat, the outboard motor occasionally is covered with sprays of water or with waves. In those circumstances, water as well as air is communicated to the engine. Also, foreign matters sometime enter the engine through the air passageway. For example, flying insects are known to build nests inside the air intake, particularly when the boat is not used for an extended period of time. For instance, mud-dauber wasps are known to build nests in the port and passage that communicates air into the engine. Such foreign matters are detrimental to the engine and its operation. During operation, insects, dirt, dust and the like, can also be ingested into the engine.

The prior art describes various devices to reduce the ingestion of water through the air intake for the internal combustion engine. United States Patent No. 4,533,331 describes an outboard motor for pleasure craft having an air vent and water drain assembly on an underside surface of the power head housing forward of the engine. The underside surface of the power head housing provides a relatively protected area for air ventilation which is away from most splashing of water. A dome-shaped valve member is movably disposed in an opening of the assembly. An annular flange extends outwardly from the valve for sealingly engaging an outer surface of the bottom wall of the housing when the valve member is pushed inwardly into the opening. The valve member also includes interior ribs which extend laterally to contact an inner surface of the bottom wall. Gravity holds the valve member in a open position permitting air to enter through the assembly through a gap between the flange and the housing. When a wave or splash of water surrounds the housing, the dome-shaped valve is lifted upwardly. This pushes the flange against the bottom of the housing and seals the gap to block water from entering. Typically, the sealing is only momentary as the splash or wave passes over and beyond the motor. After the wave passes, the valve returns to its initial open position. Any water that may have entered prior to the valve closing then drains through the valve.

U.S. Pat. No. 4,518,363 describes a vent assembly on a power head housing for an outboard motor. The vent assembly includes a ball valve mounted in the bottom wall. Gravity holds the ball valve in an open position for allowing air flow in and out of the engine compartment. In the event water rises to a level above the housing bottom wall, the ball valve floats and sealingly engages the bottom wall to prevent entry of water into the engine compartment.

Other housings provide labyrinth-style flow paths for the air which is communicated to the engine. For example, U.S. Pat. No. 4,723,927 describes a housing for a marine drive outboard motor in which the air path reverses direction several times. The inner surfaces of the sides of the cowling include separators that separate water from the incoming fresh air. Upper vent openings in the separators allow the air to escape to the engine. Discharge openings communicate with the bottom of the separators to allow water to escape out of the cowling.

While devices such as these address the operational needs for momentarily sealing the air intake from entry of water to a marine motor, other conflicting needs are not addressed, particularly that of preventing infestation and nesting of insects in such.

It is thus seen that a need remains for an apparatus for permitting the flow of air to an outboard marine motor while preventing introduction of foreign matters into the air passage and restricting the inflow of water to the engine, in a more effective and efficient manner. It is to the provision of such that the present invention is primarily directed.

SUMMARY OF THE INVENTION

In a preferred form of the invention, an air intake protection system is provided for an outboard motor of the type having an air intake port with an air plenum thereabove and an air chamber thereabout with a diverter screen mounted about the air intake port between the air chamber and the air plenum. During outboard motor operation, water spray entrained in the air flowing into the air chamber is inhibited by the diverter screen from upward entry into the air plenum and air intake port. Between outboard motor operations, foreign matters such as insects are inhibited by the diverter screen from entry into and nesting in the air plenum and the air intake port.

In another preferred form of the invention, an air intake protector is provided in a cowling for enclosing an internal combustion engine of a marine propulsion motor. The cowling is a housing for the engine with an air intake defined by a recess in a portion of the housing. A conduit extending from the recess defines a port for communicating air through a passageway to the engine. A plate is received on the port. The plate has a series of spaced-apart openings that communicate with the air intake and a central opening that aligns with the port for communication therewith. A diverter screen is removably positioned on the plate. The diverter screen covers the spaced-apart openings. The diverter screen is adapted for communicating air from the openings through it to the port while restricting flow of water therethrough. A cap removably attaches to the housing over the recess to cover the diverter screen and to define the air intake for the engine through the cowling. The diverter screen permits passage of air therethrough to the port for communicating to the engine, restricts water from flowing into the engine through the port, and prevents entry of foreign matters through the port into the passageway, particularly insects for infesting and nesting therein.

BRIEF DESCRIPTION OF THE DRAWINGS

FIG. 1 is a perspective exploded of an outboard motor with a cowling that embodies principles of the invention in a preferred form.

FIG. 2 is a cut-away end view of the cowling of FIG. 1 for illustrating details thereof.

DETAILED DESCRIPTION

Referring now in more detail to the drawings, in which like numerals indicate like parts throughout the several views, FIG. 1 shows a perspective exploded view of a marine outboard motor generally designed 10 having a diverter screen 11 of the present invention attached to a cowling 12. The outboard motor 10 in the illustrated embodiment comprises a power head 14 and a casing 16 that extends downwardly from the power head. The power head 14 includes a conventional internal combustion engine 15 for powering the boat to which the outboard motor 10 is attached. The casing 16 encloses a drive shaft 17 and a gear case 19 with gears which drive a propeller 18 that attaches at a lower end of the casing 16 for rotation. The gear case 19 and the propeller 18 normally are submerged in water during operation of the boat. A transmission connects the drive shaft and the engine together for controlling the direction of rotation of the propeller. A swivel bracket on a forward portion of the power head 14 connects the motor 10 to a transom of the boat. The swivel bracket permits the motor to pivot upwardly for carrying the boat on a trailer and to pivot downwardly to submerge the gear case and the propeller in the water for operation of the boat.

The cowling 12 defines a compartment for holding the internal combustion engine 15. The engine requires oxygen for operation, and accordingly, an air passageway 21 is provided in the cowling 12 for communicating air from the exterior of the power head housing to the carburetor of the internal combustion engine 15. The passageway 21 connects to a port 20 in the cowling 12. The port 20 in the illustrated embodiment comprises a cylindrical tube 23 that protrudes from the cowling 12. The tube 23 is disposed in a recess generally designated 22 on an aft portion of the motor 10. The recess 22 comprises a sloping bottom surface 24 with tapered sidewalls 26 and a front wall 28 which define a U-shaped recess. An aft portion of the recess 22 forms an intake opening 30, as discussed below, for entry of air to the engine in the power head housing.

A plate 32 is received in the recess 22. The plate 32 defines an annular ring of spaced-apart intake openings 34 and a central opening 36. The opening 36 is configured in cross-sectional shape to that of the port 20, so that the plate 32 is received over the port. The plate 32 extends towards the side walls 26 and the front wall 28. This defines an air chamber 33 between the bottom surface 24 and the plate 32.

The diverter screen 11 is positioned on an upper surface of the plate 32. The diverter screen 11 comprises a metallic mesh screen. The diverter screen 11 is formed from a narrow sheet of intertwined lengths of metallic fibers. In a preferred embodiment, the lengths of metallic fibers are aluminum. The intertwined fibers provide interstices in the diverter screen 11 through which air can pass, but which restrict passage of foreign matters. The diverter screen 11 accordingly provides an air permeable cover for the plate 32, for a purpose discussed below. In the illustrated embodiment, the diverter screen 11 includes an opening 40 that conforms in cross-sectional shape to that of the port 20 and of the plate opening 36. The diverter screen 11 is positioned on the plate 32 with the opening 40 aligned with the opening 36.

A cap 44 covers the recess 22 and leaves the opening 30 through which air can pass to the port 20, as discussed below. The cap 44 has an upper panel 45 from which a pair of sidewalls 46 extend downwardly. A pair of legs 48 and a backwall 50 extend downwardly from an aft edge 51 of the panel 45. A lower edge 52 of the backwall 50 contacts an upper edge surface of the diverter screen 11 to close the recess 22 above the diverter screen. The intake opening 30 to the recess 22 thus is defined by the bottom surface 24 and the plate 32. The backwall 50 and the panel 45 close the recess above the diverter screen 11 to define an air plenum 56.

FIG. 2 is a cut-away end view of the cowling 12, taken along line 2—2 shown in FIG. 1, for illustrating details of the diverter screen assembly covering the air intake of the cowling. The cowling 12 includes the port 20 in the recess 22. The plate 32 sits on an upper edge of the port 20 with its central opening 36 aligned with the aperture of the port. The diverter screen 11 sits on the upper surface of the plate 32. Although not illustrated, the diverter screen 11 can be secured to the plate 32 with nuts and bolts, clips, or other conventional mechanisms. The cap 44 is positioned on the recess 22, with the side walls 46 slidingly contacting the walls 26 of the recess. In the illustrated embodiment, an inner flange 47 extends downwardly from the panel 45. The flange 47 is parallel to and spaced-apart from the respective side wall 46. A lower edge of the flange 47 contacts an upper surface of the diverter screen 11. The cap 44 can be secured to the cowling 12 with screws (not illustrated). The upper panel 45, the flanges 47, the backwall 50, and the diverter screen 11 define the air plenum 56 above the diverter screen. The plate 32 and the bottom surface 24 of the recess 22 define the air intake 30 on the aft side of the recess and define the air chamber 33 in the recess.

With reference to both FIGS. 1 and 2, the diverter screen 11 operates to permit the flow of air to the engine held in the cowling 12; while restricting the inflow of water to the engine and preventing introduction of foreign 10 matters into the air passage. The air enters the recess 22 through the air intake 30 on the aft side of the recess 22. The air enters the air chamber 33 between the bottom surface 24 and the plate 32. The air moves through one of the openings 34 in the plate into the air plenum 56. The 15 air passes through the interstices of the diverter screen 11. The fibers in the diverter screen 11 filter particulates, insects, and other foreign matters from the air stream.

The diverter screen 11 also restricts the flow of water through the air intake 30 and the port 20. Water from a splash or a wave over the outboard motor 10 can enter the intake opening 30. Most of the water strikes the underside of the plate 32 and falls by gravity to the bottom surface 24. A portion of the water may splash upwardly through the holes 34. The interwoven fibers of the diverter screen 32 diverts the water, downwardly to the bottom surface 24. The water then flows on the sloping bottom surface 24 out of the intake opening 30. The small amount of water, if any, carried through the diverter screen 11 into the plenum 56 falls back through the openings 34. Further, the diverter screen 11 does not extend over the port 20 in the tube 23, so that water does not migrate through the diverter screen 11 into the port. The filtered air in the air plenum 56 then enters the port 20 by passing through the aligned openings 44 and 36 in the diverter screen 11 and the plate 32, respectively.

When the boat is not operated, the diverter screen 11 prevents entry of insects through the port 20 into the passage 21, such as mud-dauber wasps that construct tubular mud nests on hidden surfaces. The diverter screen 11 thus prevents introduction of insects, mud, and other matters into the air passage of the marine propulsion motor 10. Any other small holes or ports in the cowling should also, of course, be plugged or screened to prevent the entry of these unwanted matters.

The intertwined fibers of the diverter screen 11 filter the air entering the engine. After a period of operation, the cap 44 can be removed for replacement of the diverter screen 11 or for cleaning it for reinstallation.

From the foregoing, it is seen that a cowling with a diverter screen for filtering air communicated to an outboard marine motor, restricting water flow to the engine, and preventing entry of insects or foreign matters is now provided which overcomes problems associated with those cowlings of the prior art. It should be understood that the just described embodiment merely illustrates principles of the invention in a preferred form. Many modifications, additions, and deletions may, of course, be made thereto without departure from the spirit and scope of the invention as set forth in the following claims.

What is claimed is:

1. An air intake protection system for an outboard motor of the type having an air intake port with an air plenum thereabove and an air chamber thereabout, and with the system comprising a plate disposed between the air chamber and the air plenum defining both a series of spaced-apart openings that communicate with the air intake port and a port opening that permits the plate to be received on the air intake port, and a diverter screen disposed on an upper surface of the plate mounted about the air intake port between the air chamber and air plenum, whereby during outboard motor operation water spray entrained in air flowing into the air chamber is inhibited by the diverter screen from upward entry into the air plenum and air intake port, and whereby between outboard motor operations foreign matters such as insects are inhibited by the diverter screen from entry into and nesting in the air plenum and air intake port.

2. An air intake protection system for an outboard motor of the type having an air intake port with an air plenum thereabove and an air chamber therabout, and with the system comprising a mesh diverter screen mounted about the air intake port between the air chamber and air plenum, whereby during outboard motor operation water spray entrained in air flowing into the air chamber is inhibited by the diverter screen from upward entry into the air plenum and air intake port, and whereby between outboard motor operations foreign matters such as insects are inhibited by the diverter screen from entry into and nesting in the air plenum and air intake port.

3. The air intake protection system as recited in claim 2, wherein the mesh screen comprises a narrow sheet of intertwined lengths of metallic fibers.

4. The air intake protection system as recited in claim 3, wherein the metallic fibers are aluminum.

5. A cowling for enclosing a marine propulsion motor, comprising a housing for an internal combustion engine with an air intake defined by a recess in a portion of the housing, the recess including a conduit extending outwardly therefrom to define a port for communicating air to the engine, a plate received on the port and defining both a series of spaced-apart openings that communicate with the air intake and a port opening that permits the plate to be received on the port, a diverter screen removably attached to the plate and covering the spaced-apart openings, the diverter screen adapted for communicating air from the openings through the diverter screen to the port and for restricting the flow of water therethrough, and a cap removably attached to the housing over the recess to cover the diverter screen and to define an air intake for the engine through the cowling, the air passing through the openings in the plate, the diverter screen and the port, whereby during operation of the engine the diverter screen filters air passing to the engine through the port and restricts water from flowing into the engine through the port and between operation inhibiting entry into and nesting in the port by insects.

6. The cowling as recited in claim 5, wherein the diverter screen comprises a metallic mesh screen.

7. The cowling as-recited in claim 6, wherein the mesh screen comprises a narrow sheet of intertwined lengths of metallic fibers.

8. The cowling as recited in claim 7, wherein the metallic fibers are aluminum.

9. The cowling as recited in claim 5, wherein the port is an elongate cylinder and the manifold plate defines an annular port opening.

10. The cowling as recited in claim 10, wherein the spaced-apart openings define a concentric ring about the center of the port opening.

* * * * *